US008372494B2

(12) United States Patent
Mittelstadt et al.

(10) Patent No.: US 8,372,494 B2
(45) Date of Patent: Feb. 12, 2013

(54) INKJET PRINT MEDIA

(75) Inventors: Laurie S. Mittelstadt, Belmont, CA (US); Manoj K. Bhattacharyya, Palo Alto, CA (US); Hou T. Ng, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 596 days.

(21) Appl. No.: 12/608,983

(22) Filed: Oct. 29, 2009

(65) Prior Publication Data

US 2011/0104409 A1 May 5, 2011

(51) Int. Cl.
*B41M 5/00* (2006.01)

(52) U.S. Cl. ..... 428/32.21; 428/32.1; 428/32.25; 428/32.34; 162/30.11

(58) Field of Classification Search ..... 428/32.1, 428/32.21, 32.25, 32.34; 162/30.11
See application file for complete search history.

(56) References Cited

U.S. PATENT DOCUMENTS

| | | | | |
|---|---|---|---|---|
| 5,549,787 | A | 8/1996 | Sain et al. | |
| 5,626,718 | A | 5/1997 | Philippe et al. | |
| 6,123,856 | A | 9/2000 | Kumpera et al. | |
| 7,544,401 | B2 | 6/2009 | Dungworth et al. | |
| 2005/0078158 | A1 | 4/2005 | Magdassi et al. | |
| 2008/0075847 | A1* | 3/2008 | Kobayashi | 427/152 |
| 2009/0246386 | A1* | 10/2009 | Kaimoto et al. | 427/340 |
| 2011/0104406 | A1* | 5/2011 | Zhou et al. | 428/32.1 |

FOREIGN PATENT DOCUMENTS

| | | |
|---|---|---|
| EP | 0 685 594 | 12/1995 |
| JP | 2001081692 | 3/2001 |

OTHER PUBLICATIONS

Misner, M., "The Emerging World of Deinking", Waste Age, Jun. 1992, pp. 86-94.
Klass, C., "Will Ink Jet Papers Become a Deinking Nightmare?", Paper 360°, Jan./Feb. 2009, pp. 10-13.
Kemper, M., "State-of-the-Art and New Technologies in Flotation Deinking", International Journal of Mineral Processing, vol. 56 (1999), pp. 317-333.
Carre et al. "Digital Prints: A Survey of the Various Deinkability Behaviors" Published in the DPP 2005 Proceedings, pp. 1-5.
Hannuksela et al,, "Deinking Chemistry", Published Online as Chapter 6, Deinking Primer—The Book, Last Updated Oct. 9, 2008, pp. 1-12.

* cited by examiner

*Primary Examiner* — Betelhem Shewareged

(57) ABSTRACT

An inkjet print medium includes a base substrate, a layer of a deinking solution at least partially diffused into the base substrate, and an ink-receiving layer established on the layer of the deinking solution. The deinking solution includes a flocculant in an amount ranging from about 0.1 wt. % to about 40 wt. % of a total wt. % of the deinking solution.

18 Claims, 1 Drawing Sheet

INKJET PRINT MEDIA

BACKGROUND

The present disclosure relates generally to inkjet print media.

Ink-jet recording is performed such that droplets of ink are expelled from a printhead to the surface of a print medium. The droplets are adhered to the print medium to print images and/or characters. Ink-jet printing has many advantages including relatively high speed, and ease of multi-colored image production. Ink-jet printing is evolving to become a dominant form of digital commercial printing, where deinking is used to enable recycling of waste. As such, inkjet prints have become part of the mixed paper waste stream.

BRIEF DESCRIPTION OF THE DRAWINGS

Features and advantages of embodiments of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Embodiments of the inkjet media disclosed herein facilitate the removal of ink printed thereon during deinking processes. The inkjet media incorporates flocculants into a sub-layer sandwiched between a base substrate and an outermost ink-receiving layer. The positioning of the flocculants is advantageous for a number of reasons. The isolation of the flocculants from the inkjet ink during printing ensures that they do not deleteriously affect the printing of inks on the media (i.e., the ink particles remain well-dispersed in ink form). Furthermore, during standard deinking processes, the flocculants are released and thus are present at the most desired area for agglomerating the colorant particles of the printed ink. For at least these reasons, digital prints generated using embodiments of the media disclosed herein are readily recyclable. Standard recycling processes are used for a variety of media, including those used in offset printing. As such, the inkjet print media disclosed herein may be part of a mixed waste stream during recycling. The inclusion of the flocculant in the sub-layer of the media disclosed herein advantageously places the deinking chemicals where they are needed and releases them when they are needed during deinking. As such, multiple types of printed media, including the embodiments of the inkjet print media disclosed herein, may be recycled together without deleteriously affecting the recycling process of the other media.

Furthermore, having the flocculant present locally on the medium may be more efficient and economical than adding flocculants to an entire batch during standard deinking processes.

Figure 1:
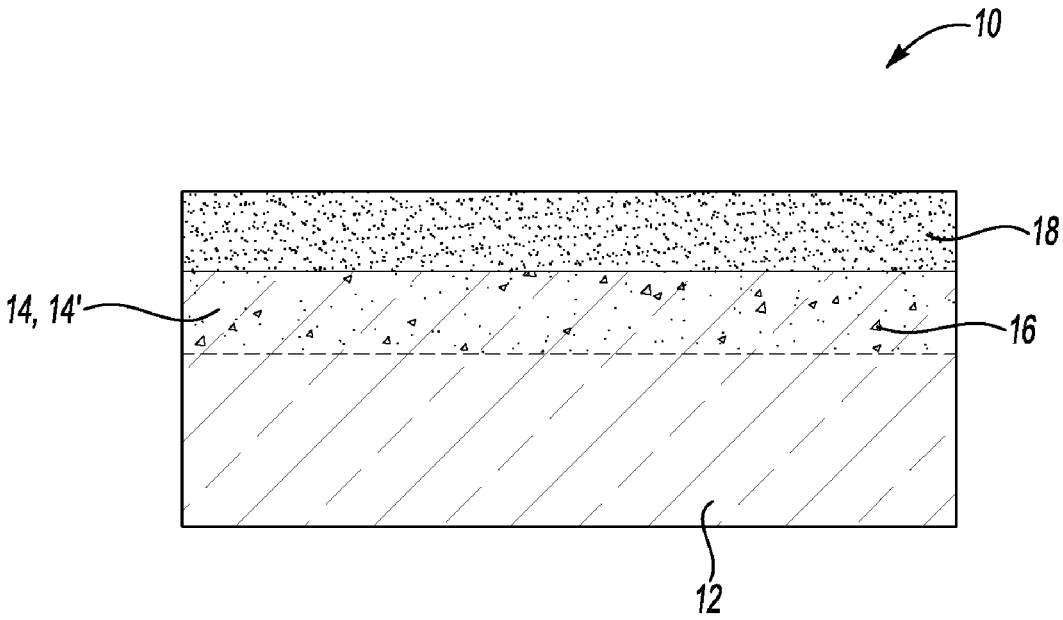
FIG. 1 is a schematic cross-sectional view of an embodiment of the inkjet media disclosed herein.

Referring now to FIG. 1, a cross-section of an embodiment of the medium 10 is schematically depicted. The medium 10 includes a base substrate 12. In one embodiment the base substrate 12 is plain paper (e.g., copy paper). The plain paper may be made of a fabric stock having a weight ranging from about 60 gram/$m^2$ (gsm) to about 300 gsm. In a non-limitative example, the weight ranges from about 70 gsm to about 200 gsm. A plain paper base substrate 12 may also include any suitable wood or non-wood pulp. Non-limitative examples of suitable pulps include groundwood pulp, sulfite pulp, chemically ground pulp, refiner ground pulp, thermomechanical pulp, and/or mixtures thereof. Fillers may also be incorporated into the pulp, for example, to substantially control physical properties of the final coated paper. Examples of the fillers include, but are not limited to ground calcium carbonate, precipitated calcium carbonate, titanium dioxide, kaolin, clay, silicates, and/or mixtures thereof. It is to be understood that any desirable amount of filler may be used. In one embodiment, the amount of filler ranges from about 0 wt. % to about 40 wt. % of the substrate 12, and in another embodiment, the amount of filler ranges from about 5 wt. % to about 15 wt. % of the substrate 12. In another embodiment, the base substrate 12 is synthetic paper, which is a polymer-based paper instead of a wood-based paper.

Established on, and ultimately in at least a portion of, the base substrate 12 is a deinking solution 14. The deinking solution 14 includes one or more flocculants 16 dispersed in a suitable aqueous medium/vehicle. In an embodiment, the aqueous vehicle is water. In another embodiment, the aqueous vehicle is a mixture of water and isopropyl alcohol.

The flocculants 16 are generally positively charged particles. Non-limiting examples of such flocculants 16 include inorganic salts (e.g., aluminum salts, sodium salts, calcium salts, etc.), modified polyacrylamide, or natural products, such as starch-based gels. More specific examples of the inorganic salt flocculants 16 that may be used include aluminum sulfate, sodium silicate, calcium hydroxide, and sodium aluminate. Further, more specific examples of the modified polyacrylamide that may be used include poly(1-carbamoylethylene), polyacrylamide 75, polyacrylamide 50, NSC9707, Still further, more specific examples of suitable natural products include mixtures of amylase and amylpectin, chitosan, moringa oleifera, papain, and isinglass. The amount of flocculant 16 present ranges from about 0.1 wt % to about 40 wt % of the total weight of the solution 14. In other embodiments, the amount of flocculant 16 present ranges from about 0.1 wt % to about 15 wt % of the total weight of the solution 14. Generally, the upper and lower limits of such ranges include ±0.05 of the stated values. It is to be understood that the amount of flocculants 16 present also ranges from about 0.01 wt. % to about 5 wt. % of the total weight of the base substrate 12. In some instances, the upper limit of the flocculants 16 is up to 0.1 wt. % of the total weight of the base substrate 12.

The deinking solution 14 may also include surfactants. The addition of surfactants aids in the substantially uniform distribution of the solution on the base substrate 12. In an embodiment, the surfactant is present in an amount ranging from 0.01 wt % to 2 wt % of the total weight of the solution 14. Non-limiting examples of suitable surfactants includes ammonium lauryl sulfate or fatty acid salts.

The solution containing the aqueous medium/vehicle, the flocculant(s) 16, and, in some instances, the surfactant(s) is prepared and then deposited on the base substrate 12. Deposition of the solution 14 on the substrate 12 may be accomplished via roll-coating, conventional slot-die processing, blade coating (including doctor blade coating), bent blade coating, rod coating, shear roll coating, slot-die cascade coating, pond coating, curtain coating and/or other comparable methods including those that use circulating and non-circulating coating technologies. In certain instances, spray-coating, immersion-coating, and/or cast-coating techniques may be suitable for depositing.

The deinking solution 14 is initially deposited on the base substrate 12. The thickness of the deposited solution may range from about 100 nanometers to about 1 micron. However, due, at least in part, to the binder-less nature of the deinking solution 14, the deinking solution 14 is at least partially diffused into the underlying base substrate 12. Upon being dried, the deinking solution 14 forms a thin deinking layer 14' on the base substrate 12 such that at least a portion of such layer 14' is diffused in the base substrate 12. In one embodiment, the thickness of the dried deinking layer 14' ranges from about 10 nm to about 500 nm.

The medium 10 further includes an ink-receiving layer 18 established on the deinking layer 14'. It is to be understood that the deinking solution 14 is dried to form the partially diffused deinking layer 14' prior to depositing the ink-receiving layer 18 thereon. Such drying may occur in air, or may be accelerated by exposing the solution 14 to heat.

The ink-receiving layer 18 is generally configured to achieve a desirable level of glossiness, ink absorption, and print durability. The solution used to form the ink-receiving layer 18 includes at least fillers, binders, and ink fixing agents. Some non-limiting examples of fillers and binders include alumina, silica, and polyvinyl alcohol. Non-limiting examples of the fixing agent includes calcium salts. The environment at the surface of the medium 10 is different than the environment at which the deinking layer 14' is positioned. As such, the calcium salts in the ink-receiving layer 18 act as fixing agents as opposed to flocculants, and the colorant printed thereon becomes mechanically and chemically fixed onto the surface of the base substrate 12 (i.e., in the ink-receiving layer 18) until the medium 10 is exposed to a pulping process.

It is to be understood that the solution that forms the ink-receiving layer 18 may be deposited using any of the techniques previously described for depositing the solution 14.

The thickness of the ink-receiving layer 18 is generally large enough to isolate any inkjet colorants present in the layer after printing is performed from the flocculants 16 in the underlying substrate 12. While some of the inkjet colorants may diffuse into the base substrate 12 and contact the deinking solution 14 after printing, it is to be understood that an ink-receiving layer thickness ranging from about 500 nanometers to about 5 microns contributes to minimizing this phenomenon. Without being bound to any theory, it is believed that upon being printed and prior to exposure to any deinking process, the inkjet colorants tend to stay near the surface of the medium 10 (i.e., in the ink-receiving layer 18), and that the concentration of the colorants in contact with the deinking layer 14' is generally too low for the colorants to prematurely agglomerate in an undesirable manner.

Figure 2:
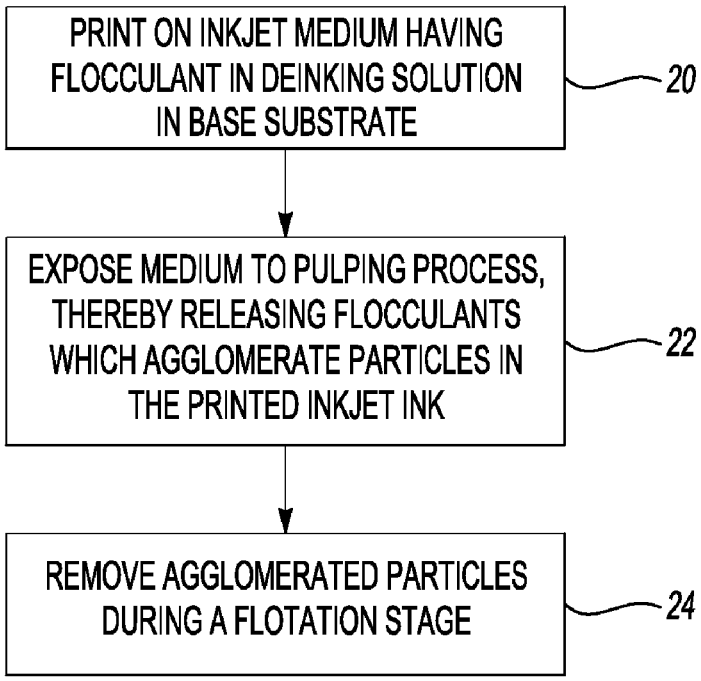
FIG. 2 is a flow diagram illustrating an embodiment of a method for using an embodiment of the inkjet media disclosed herein.

Referring now to FIG. 2, an embodiment of a method of using the medium 10 is disclosed. It is to be understood that the printing step (shown at reference numeral 20) and the recycling steps (shown at reference numerals 22 and 24) may or may not be performed by the same entity. In most instances, the printing is performed by some form of consumer or print service provider, who then ultimately discards of the printed-on medium 10 for recycling. Another entity, having the capability of performing the recycling steps, receives the printed-on medium 10 and initiates the deinking process.

At the outset of the method shown in FIG. 2, one or more inkjet inks are printed on the medium 10, as shown at reference numeral 20. Any inkjet ink including colorants, such as pigment particles and/or dyes may be used. Such inks may be colored inks and/or black inks, printed alone or together. Furthermore, any inkjet printing process may be used, including drop-on-demand inkjet printing (e.g., thermal inkjet printing or piezoelectric inkjet printing), or continuous inkjet printing.

When it is desirable to recycle the printed-in medium 10, the method involves performing a standard deinking process, which involves at least a pulping stage (see reference numeral 22) and an flotation stage (see reference numeral 24). More specifically, deinking processes include pulping, coarse and/or fine screen washing, flotation, dispersing, thickening, and then storing. Each of these stages is performed in aqueous environments.

During the pulping process, the print media 10, water, and any other deinking chemicals are added to a pulper. Other chemicals that may also be added to the pulper include, but are not limited to, sodium silicate, hydrogen peroxide, fatty acid soap, calcium chloride, and enzymes. Depending on the configuration of the pulper, a propeller-like or twin-screw like mechanism may be used to mechanically break down the fibers and ink-receiving layer 18. During this stage, the paper fibers swell, and the flocculant 16 and colorants of inkjet ink(s) printed on the medium 10 become dispersed in the pulping fluid. Upon being released, the flocculants 16 and pigment particles interact in the pulping fluid. More specifically, the flocculant 16 acts as a collecting agent by agglomerating the colorant particles or molecules together. The flocculant 16 enables the dispersed colorants to contact and adhere to form clusters that are larger than the individual colorants. Generally, the amount of flocculant 16 present is able to agglomerate the colorants so that they are not too large and heavy, but are able to overcome electrostatic repulsion to form clusters large enough for flotation. In an embodiment the clusters range from about 10 microns to about 150 microns.

It is believed that since the flocculant 16 is present locally with respect to the printed inkjet ink, standard deinking processes may be used without contaminating the pulping fluid. As such, the chemical environment of the pulping process is not deleteriously affected, at least in part, because additional flocculants (other than those present in the medium 10) are not added to the pulping fluid. It is further believed that because the flocculant 16 is present in the medium 10 itself, standard deinking and recycling processes for mixed papers may be used because additional chemicals (that may be deleterious to one type of paper pulp but advantageous for ink removal from another type of paper pulp) are not added to the pulping fluid.

After the pulping process is complete, a flotation process (or other similar cluster removal process) may be performed. During the flotation process, the agglomerated colorants (i.e., the clusters) gather at the edges of bubbles which circulate to the top of a flotation cell and are removed. The flotation process separates the colorants from the remaining fibers via the interaction with the bubbles. In an embodiment, the removal of the agglomerated particles may be accomplished in a single-stage floatation process, and in other embodiments, multi-stage flotation processes are required. Since most of the colorants are within a desirable size range and thus are able to be removed via flotation, this embodiment substantially reduces the side effect of stained fibers and recycled process water.

In some embodiments, a screen washing step is performed either before or after the flotation process. During this step, extra large particle agglomerates may be removed.

As discussed herein, embodiments of the medium 10 include flocculants 16 locally within a sub-layer of the base substrate 12 as a result of diffusion of the solution 14 into the substrate 12. As such, the flocculant 16 is added to the medium 10 as supplied. The addition of the flocculants 16 in the manner described herein advantageously enables the colorants in inkjet inks printed on the medium 10 to remain well-dispersed and jettable in the ink form, but also allows agglomerations of such colorants to form during deinking.

While several embodiments have been described in detail, it will be apparent to those skilled in the art that the disclosed embodiments may be modified. Therefore, the foregoing description is to be considered exemplary rather than limiting.

What is claimed is:

1. An inkjet print medium, comprising:

a base substrate;

a layer of a deinking solution at least partially diffused into the base substrate, the deinking solution being binder-less and including a flocculant in an amount ranging from about 0.1 wt. % to about 40 wt. % of a total wt. % of the solution; and an ink-receiving layer established on the layer of the deinking solution.

2. The inkjet print medium as defined in claim 1 wherein the base substrate is selected from wood-based paper and synthetic paper.

3. The inkjet print medium as defined in claim 1 wherein the flocculant is selected from aluminum salts, positively charged polyacrylamide, sodium salts, starch-based gels, calcium salts, and combinations thereof.

4. The inkjet print medium as defined in claim 1 wherein the deinking solution further includes a surfactant in an amount ranging from about 0.01 wt. % to about 2 wt. % of the total wt. % of the solution used to form the deinking layer.

5. The inkjet print medium as defined in claim 1 wherein the deinking solution includes an aqueous vehicle in which the flocculant is dispersed.

6. The inkjet print medium as defined in claim 1 wherein the flocculant is configured to be isolated from an inkjet ink printed on the ink-receiving layer until the inkjet medium is exposed to a deinking process.

7. The inkjet print medium as defined in claim 1 wherein the flocculant is present in an amount ranging from about 0.1 wt. % to about 15 wt. % of a total wt. % of the solution.

8. A deinking process, comprising:

exposing the inkjet print medium of claim 1 to a pulping process, the inkjet print medium having an inkjet ink printed on at least a portion of the ink-receiving layer, whereby the flocculant in the deinking solution is released and agglomerates colorants of the inkjet ink; and removing the agglomerated particles.

9. The deinking process as defined in claim 8 wherein removing the agglomerated particles takes place during a single floatation process.

10. The deinking process as defined in claim 8 wherein the pulping process is accomplished without additional flocculants, beyond the flocculant in the print inkjet medium, being added during the process.

11. A method for making an inkjet print medium, comprising:

establishing a layer of a deinking solution on a surface of a base substrate, whereby the deinking solution at least partially diffuses into the base substrate, the deinking solution being binder-less and including a flocculant in an amount ranging from about 0.1 wt. % to about 40 wt. % of a total wt. % of the deinking solution; and establishing an ink-receiving layer on the layer of the deinking solution.

12. The method as defined in claim 11, further comprising selecting the flocculant from the group consisting of aluminum salts, positively charged polyacrylamide, sodium salts, starch-based gels, calcium salts, and combinations thereof.

13. The method as defined in claim 11 wherein prior to establishing the deinking solution, the method further comprises dispersing the flocculant in an aqueous vehicle.

14. The method as defined in claim 11 wherein establishing the deinking solution includes depositing the deinking solution by doctor blade coating or curtain coating, and wherein establishing the ink-receiving layer is accomplished by doctor blade coating or curtain coating.

15. The method as defined in claim 14, further comprising drying the deposited deinking solution to form the layer of the deinking solution prior to establishing the ink-receiving layer on the layer of the deinking solution.

16. An inkjet print medium, comprising:

a base substrate;

a deinking layer including a deinking solution that is dried and at least partially diffused into the base substrate, the deinking solution being binder-less and including:

an aqueous-based vehicle;

a flocculant dispersed in the aqueous-based vehicle in an amount ranging from about 0.1 wt. % to about 15 wt. % of a total wt. % of the solution; and a surfactant in an amount ranging from about 0.01 wt. % to about 2 wt.% of the total wt. % of the solution;

an ink-receiving layer established on the deinking layer;

wherein the ink-receiving layer is configured to isolate the flocculant in the deinking layer from colorants of an inkjet ink printed on the medium until the medium is exposed to a deinking process.

17. The inkjet print medium as defined in claim 16 wherein the base substrate is selected from wood-based paper and synthetic paper.

18. The inkjet print medium as defined in claim 16 wherein the flocculant is selected from aluminum salts, positively charged polyacrylamide, sodium salts, starch-based gels, calcium salts, and combinations thereof.

* * * * *